US005641396A

United States Patent [19]

Braden et al.

[11] Patent Number: 5,641,396

[45] Date of Patent: Jun. 24, 1997

[54] USE OF 2-AMINO-1-METHOXYPROPANE AS A NEUTRALIZING AMINE IN REFINERY PROCESSES

[75] Inventors: Veronica K. Braden, Sugar Land; Tannon S. Woodson, Houston, both of Tex.

[73] Assignee: Nalco/Exxon Energy Chemicals L. P., Sugarland, Tex.

[21] Appl. No.: 529,890

[22] Filed: Sep. 18, 1995

[51] Int. Cl.[6] ..... C10G 7/10

[52] U.S. Cl. ..... 208/348; 208/47; 203/7

[58] Field of Search ..... 208/348, 47; 203/7

[56] References Cited

U.S. PATENT DOCUMENTS

| | | | |
|---|---|---|---|
| 3,779,905 | 12/1973 | Stedman | 208/348 |
| 4,062,764 | 12/1977 | White et al. | 203/7 |
| 4,229,284 | 10/1980 | White et al. | 208/348 |
| 4,430,196 | 2/1984 | Niu | 208/47 |
| 4,806,229 | 2/1989 | Ferguson et al. | 208/47 |
| 5,211,840 | 5/1993 | Lehrer et al. | 208/348 |

*Primary Examiner*—Walter D. Griffin
*Attorney, Agent, or Firm*—Robert A. Miller; James J. Drake

[57] ABSTRACT

2-amino-1-methoxypropane is used as a neutralizing amine in crude oil distillation units. The amine of the invention gives superior neutralization at the first initial condensate compared to other commonly used neutralizing amines.

5 Claims, No Drawings

USE OF 2-AMINO-1-METHOXYPROPANE AS A NEUTRALIZING AMINE IN REFINERY PROCESSES

FIELD OF THE INVENTION

This invention relates to the control of corrosion of the metal surfaces of refinery processing equipment and more specifically toward preventing the corrosion of the overhead lines of refinery equipment used to distill crude oil.

BACKGROUND OF THE INVENTION

The first step in the refining of crude oil is to water wash the crude using a desalter to break the emulsion. The purpose of the desalting process is to remove water soluble salts and other solids from the crude oil. The water soluble salts which are removed from the crude oil by the desalting process include sodium, magnesium and calcium chlorides. While desalting processes remove great quantities of these salts, the desalting process does not quantitatively remove all salts, and as a result, some of the salts remain in the crude oil. If these salts are not removed prior to distillation, they may react with residual water in the crude oil and hydrolyze to hydrochloric acid when the crude oil is later distilled at temperatures of 650°–750° F. Hydrochloric acid then may distill up the tower, and where water condenses, may cause corrosion on the metal surfaces of the column and associated equipment in contact with condensing water. The most undesirable salt present in the crude oil is calcium chloride. Calcium chloride is the most difficult salt to remove in the water wash desalting process, and is the most susceptible to hydrolysis during the later processing of crude oil.

After the desalting process, the next step in the processing of the crude oil into useful products is its distillation into fractions having varying boiling points and uses. During this separation process, lower boiling fractions are recovered as overhead fractions from the distillation zones. These fractions are collected as side-cuts, cooled, condensed, and sent to collecting equipment. During this process volatile acid components such as $H_2S$, HCl, $CO_2$ and various organic acids such as naphthenic acids are distilled from these fractions. These volatile acids may collect in the trays of distillation equipment or condense on other cooler surfaces where they may cause substantial damage to the column or other handling equipment if left untreated.

Corrosive attack on the metals normally used in the low temperature sections of a refinery processing unit, where water is present below its dew point, is greatly accelerated in the presence of acid. The water present may be water entrained in the hydrocarbons being processed, or may come from water added to the system such as for example steam stripping. Acidity of the condensed water is due to dissolved acids in the condensate, principally HCl, organic acids and $H_2S$ and sometimes $CO_2$. HCl is the most troublesome of the acids normally encountered and is formed by the hydrolysis of salts normally present in the crude oil being treated.

Corrosion may occur on any metal surface in contact with the distilling hydrocarbon liquid. The most difficult to treat locations where corrosion may take place are tower top trays, overhead lines, condensers, and the top pump around exchangers. It is usually within these areas that water condensation is formed or carded along with the process stream. The top temperature of the fractionating column is usually, but not always, maintained about at or above the dew point of water. The aqueous condensate which forms at or below the dewpoint often contains a significant concentration of the acidic components listed above. This high concentration of acidic components renders the pH of the condensate highly acidic and corrosive. Neutralizing treatments have been used to adjust the pH of the condensate to a more neutral pH value in the hope of minimizing corrosion at those points where the condensate contacts corrodible metal surfaces.

One of the problems with respect to controlling corrosion in systems of this type occurs above and in the temperature range of the initial condensation of water in the refining unit. This is an area where the temperature of the surrounding environment reaches the dew point of water. At this point, a mixture of water, hydrocarbon and vapor may be present. Such initial condensate may occur within the distilling unit itself or in subsequent condensers. The top temperature of the fractionating column is normally maintained above the dew point of water. The initial aqueous condensate formed contains a high percentage of HCl. Due to the high concentrations of acids dissolved in the water, the pH of the first condensate is quite low. For this reason, the water is highly corrosive. It is important therefore that the first condensate be rendered less corrosive.

In the past, ammonia has been added at various points in the distillation circuit in an attempt to control the corrosiveness of condensed acidic materials. Ammonia however has not proven to be effective with respect to the elimination of corrosion caused by the initial condensate. It is believed that the reason ammonia has been ineffective for this purpose is that it does not condense quickly enough to neutralize the acidic components of the first condensate. The ammonia tends to stay in the vapor phase until at least the point of the second condensation. Ammonia injection to neutralize hydrochloric acid may in some systems effectively neutralize the acid, but, ammonia chloride salt formation may occur ahead of the dew point of water. Other problems that have become associated with ammonia use include poor pH control in the initial dew point, variability in injection and underdeposit corrosion.

In an attempt to overcome the disadvantages of ammonia, certain organic neutralizing amines have been tried. These agents included morpholine, ethylenediamine as well as other volatile amine materials.

1,3-methoxypropylamine is disclosed as a neutralizing amine U.S. Pat. No. 4,062,764, the disclosure of which is hereinafter incorporated by reference into this specification. 1,3-methoxypropylamine has been used to successfully control or inhibit corrosion that ordinarily occurs at the point of initial condensation within or after the distillation unit. The addition of methoxypropylamine to the petroleum fractionating system substantially raises the pH of the initial condensate rendering the material noncorrosive or substantially less corrosive than was previously possible. The inhibitor can be added to the system either in pure form or as an aqueous solution. A sufficient amount of inhibitor is added to raise the pH of the liquid at the point of initial condensation to above 4.5 and preferable, to at least about 5.0.

While a great advance, the use of these amines for treating the initial condensate created an unanticipated problem, the formation of hydrochloride salts of the amines which formed around distillation coitus, column pumparounds, overhead lines and in overhead heat exchangers. These deposits manifest themselves after the particular amine has been used for a long period of time. These deposits can cause both fouling and corrosion problems and are most problematic in traits that do not use a water-wash.

Attempts have been made to solve the problem of amine salt formation in these systems. U.S. Pat. No. 5,211,840 discloses the use of neutralizing amines having a pKa of from 5 to 8 which permit the formation of amine chloride salts after the water dew point is reached, i.e.: which do not condense at temperatures above the dew point of water.

Because of oil pricing, availability, and need, quality of crude oils processed in refineries has generally declined, problems associated with ammonia injection have increased. Because of deposit formation caused by ammonium chloride, narrowing of lines, restricted flow, and underdeposit corrosion, all unacceptable situations can occur. As a result of problems associated with ammonia, a switch has been made to organic amines of the types described above. These amines react with the chlorides in the overhead condensing system. The potential problems that can occur with high chloride loadings are fouling and corrosion due to salt deposition occurring on surfaces ahead of the dewpoint of water.

The amine chloride corrosion deposition phenomena can be explained in the following manner. At a given temperature the vapor in a distilling petroleum product is capable of supporting a given mole fraction of ammonium chloride. If this mole fraction is exceeded, ammonium chloride will deposit on surfaces in contact with the vapor. Partial pressure is equal to the mole fraction times the total pressure. At equilibrium, the partial pressure of ammonium chloride over the internal surface on which ammonium chloride has deposited equals the vapor pressure of ammonium chloride at the temperature of the internal surface. If the partial pressure of ammonium chloride above the internal surface exceeds the vapor/equilibrium pressure, then ammonium chloride will precipitate on the surface and accumulate.

Studies indicate that the sublimation of ammonium chloride results in the formation of two moles of gas. It thus appears that the sublimation or vaporization of the salts results in the decomposition into ammonia and hydrogen chloride.

In order to control corrosion, the organic amines of the art are injected as either a neat solution, or diluted in an organic solvent to achieve an overhead accumulator water pH value of 5–6. To be an effective neutralizer, the organic amine should have a distillation profile similar to that of water, a basicity greater than that of ammonia, and a salt melt point of less than 230° F. The ability of an organic amine to act as a neutralizer without the decomposition of the amine chloride salt ahead of the dewpoint of water is measured in partial pressure of chloride in millimeters of mercury (mm Hg). As stated above, one of the most commercially and technically successful organic neutralizing amines is 1,3-methoxypropylamine. 1,3-methoxypropylamine is able to handle 0.006 mm Hg of chlorides based on testing with a neutralizer evaluation unit described hereinafter. When the partial pressure of 0.006 mm Hg is exceeded however, corrosion occurs ahead of dew point due to the deposition of 1,3-methoxypropylamine chloride salts.

It would therefore be an improvement in the art of corrosion control during the distillation of crude oils, petroleum feedstocks containing chlorides, organic materials containing chloride salts, and the like if a new neutralizing amine could be found which would have superior properties to that of currently available, and commercially used materials. It would be a benefit to the art if a new neutralizing material could be found which would provide superior corrosion protection, act to neutralize hydrogen chloride, and which would not form chloride deposits at very low partial pressures.

The neutralizing amine of the subject invention provides an amine material which acts as an effective acid neutralizer in refining systems at both above, and below the dew point of water.

This invention is accordingly directed to a process for neutralizing the acidic components in the initial condensate of a distilling petroleum product in a refining unit comprising the steps of adding a neutralizing amount of 2-amino-1-methoxypropane to the petroleum product as it passes through the refining unit. Preferably, 2-amino-1-methoxypropane is added to the overhead line of the distilling unit or the side stream inlets to the tower. Additionally, the neutralizing amine of this invention may be added to the crude oil before the product passes through the fractionating column of the distilling unit.

Most preferably, to minimize corrosion, sufficient 2-amino-1-methoxypropane is added to either the crude oil prior to passing it through the fractionation unit or to the overhead line so as to raise the pH of the initial water of condensation to above 4.0, and most preferably to above a pH of 5.0. Ideally, the 2-amino-1-methoxypropane neutralizer of this invention is added on a continuous basis to the petroleum product being distilled or to the overhead line of the fractionating tower being treated.

THE INVENTION

We have discovered that 2-amino-1-methoxypropane is a superior organic neutralizing and distillation equipment by adding an effective neutralizing amount of2-amino-1-methoxypropane to petroleum as it passes through the distillation process.

In one sense, our invention is directed to a process for neutralizing the acidic components in the aqueous condensate formed during the distillation of petroleum in a distillation unit which comprises adding to the such unit an effective neutralizing amount of2-amino-1-methoxypropane. The term petroleum as used herein refers to crude petroleum, or any other petroleum fraction including distillates, residua, or the like which material contains acidic components.

The term distillation unit is meant to include distillation or fractionation columns including trays contained therein, condensers, recycle lines, pumparounds, receiving vessels, distillation vessels, and other equipment in contact with condensing vapor resulting from the distillation of petroleum. The practice of this invention reduces corrosion occurring in the overhead lines and distillation columns, trays of distillation columns and the like of equipment utilized in the refining and purification of petroleum. In another aspect, this invention is related to a continuous process for neutralizing the acidic components dissolved in the water of the aqueous condensate of a distilling petroleum product, which product is distilled in a distillation unit containing a fractionating tower and an overhead line which comprises continuously adding an effective neutralizing amount of 2-amino-1-methoxypropane to the aqueous condensate containing acidic components.

In the practice of this invention, it is not important where the 2-amino-1-methoxypropane is added so long as it is vaporized in the overhead and thus present in the overhead and distillation column, and related equipment such as pumparounds, recycle lines, and the like so as to be present to neutralize any acid species which may condense. In common practice the neutralizing amine of this invention is added to the overhead vapor line of the distillation column. The amine may also be added to the top reflux return or pumparound section of the distillation column thus protecting the surfaces of the column, condensers and the like in contact with condensing acidic vapors. The amine can also be added to the petroleum product prior to distillation, or fed to the unit through the distillation column, condenser, pumparound or the like during the distillation process. The amount of 2-amino-1-methoxypropane used to neutralize the acidic components in a distillation process is that which is effective to neutralize the acidic components, rendering them more harmless from a corrosion viewpoint. As such, the 2-amino-1-methoxypropane is generally added to the distilling petroleum product based upon the amount of chloride salt present in the petroleum being distilled. 2-amino-1-methoxypropane is both oil and water soluble, and thus can be fed into the system neat, or as either an aqueous or organic solution. While it is preferred to add the amine neat, there are situations where diluting the amine with water or a hydrocarbon solvent is desirable prior to feeding to the unit. When added as an aqueous solution it is sometimes convenient to dilute the 2-amino-1-methoxypropane to a concentration of from 10–50% by weight.

Further, it may advantageously be combined with other amine materials to obtain cumulative effects of amines having different dew point and volatility characteristics. In the practice of the invention, the 2-amino-1-methoxypropane is added so as to be present in areas where acidic vapors condense. As such it is added in sufficient quantity to raise the pH value of the aqueous condensate to above a pH value of about 5, and preferably above a pH value of about 6. This is to render the condensate a high enough pH value to stop, or at least minimize acid corrosion.

We have discovered that 2-amino-1-methoxypropane adequately controls dew point pH, is capable of handling 0.012 mm Hg chlorides, two times that of 1,3-methoxypropylamine without leading to amine chloride salt deposition. 2-amino-1-methoxypropane is available commercially from Air Products and Chemicals, Inc., Allentown, Pa. 2-amino-1-methoxypropane is also known as 1,2-methoxypropylamine or methoxyisopropylamine. 2-amino-1-methoxypropane is reported by its manufacturer to have a vapor pressure (mm Hg) of 11° at 15° C., a boiling point of 99° C., and a specific gravity of 0.847° at 15.6° C.

A testing apparatus was constructed in order to evaluate the neutralizing amine of this invention. The apparatus consisted of a laboratory scale distillation tower constructed of glass. It consisted of a 15 sieve tray Oldershaw column, a thermosiphoning reboiler, a series of overhead condensers including a first horizontal condenser, a second vertical condenser, and a series of 3 horizontal condensers connected to a condensate accumulator. Corrosion probes and thermocouples are inserted at the top of the Oldershaw column, at the juncture between the first vertical and first horizontal condenser, and a the juncture between the bottom of the vertical condenser and the third horizontal condense. A commercially available naphtha having a boiling range of 316°–358° F., a specific gravity of 0.771, an API of 52, and a molecular weight of 135 was selected to afford an overhead temperature of 310°–320° F. The apparatus was designed to simulate a tower tray or an overhead system of a condensing stream. The unit is operated at one atmosphere total pressure.

The Oldershaw sieve tower contains fifteen trays. They are numbered one to fifteen from the bottom to the top. The aqueous acid solution is heated to 400° F. and injected with a hydrocarbon slip-stream between tray 5 and tray 6. The aqueous neutralizer solution is heated to 370° F. and injected with a hydrocarbon slip-stream between tray 10 and tray 11. A continuous nitrogen sparge of 15 ml/minute was also added. The acid and neutralizer concentrations and injection rate are varied to simulate a give water, acid and neutralizer partial pressure. The hydrocarbon is injected at a rate of 34 ml/min into the reboiler which is electrically heated. It then distills up the column where it combines with the vaporized acid and the vaporized neutralizer.

Thermocouples are located in the reboiler, tray 5, tray 10, tray 15, the lower top, the top of the vertical condenser, and the bottom of the vertical condenser. Temperatures are measured and interfaced with an automatic temperature recording unit. The hydrocarbon slip-streams, acid and corrosion protection additive are on load cells that interface with the automatic temperature recording unit to give average readings at one and five minute feed rates.

Corrosion probes are located at the top of the tower, the top of the vertical condenser and the bottom of the vertical condenser. The electrical resistance corrosion probe is a carbon steel 4 mil tubular probe. Corrosion readings are taken manually every thirty minutes.

Initial dew point is typically at the first sample well which is sampled periodically to insure good dew point neutralization. Each individual run is conducted for 6 or 7 hours to allow sufficient time for amine salt deposition and corrosion to occur and be accurately measured. After the run is completed, the unit is cooled and the corrosion probes are washed with 15 grams of deionized water.

The probe washings are analyzed for amine content. The hydrocarbon injection rate is held constant, while the water, acid and neutralizer concentrations are varied to increase or decrease the partial pressure of chloride and amine to determine the vapor pressure limits of the amine salts at a selected temperature of between 240°–260° F.

The unit was operated under the following conditions:

| Operating Conditions of Test Unit | |
|---|---|
| Reboiler Hydrocarbon Feed Rate | 34 ml/min |
| Neutralizer Hydrocarbon Slip Stream | 8 ml/min |
| Acid Hydrocarbon Slip Stream | 8 ml/min |
| Aqueous Acid Feed Rate | 3.25 ml/min |
| Aqueous Neutralizer Feed Rate | 3.24 ml/min |
| Acid Injection Temperature | 400° F. |
| Neutralizer Injection Temperature | 370° F. |
| Tower Top Probe #1 Temperature | 284° F. |
| Condenser Top Probe #2 Temperature | 275° F. |
| Silicon Oil Recirculating Bath #1 | 100° C. |
| Silicon Oil Recirculating Bath #2 | 90° C. |

Calculations used to determine the results below are:

Naphtha (moles/hr)=(naphtha BPD)(42 g/bbl)(8.341 lb/gal)(24 hr/day)(135#/mole)

Steam (mol/hr)=(#hr)/18 #/mole

Total Overhead (mol/hr)=Naphtha (mol/hr)+Steam(mol/hr)

Mole % Overhead Naphtha rate=Naphtha (moles/hr)/Total (moles/hr)

Ovhd chloride rate (#/hr)=(Cl ppm)(ovhd water rate#/hr)($1\times 10^6$)

Mole Cl=(Cl #/hr)/Cl mol. wt)

Chloride mole fraction=(Cl moles/hr)/(Total moles/hr)

Partial Pressure Cl=(Cl mole fraction)(Total pressure mm Hg)

During the testing, acid concentration was varied from 0.005N to 0.0016N to determine the vapor pressure limit for 2amino-1-methoxypropane and 1,3-methoxypropylamine. The neutralizer concentration was estimated to be 10–20% excess of the acid concentration fed. The excess neutralizer concentration is required to insure good initial dew point pH control. Three acid concentrations were evaluated for 2-amino-1-methoxypropane while four acid concentrations were used in the evaluation of 1,3-methoxypropylamine. The results including corrosion rates are found below in Tables 1 and 2.

TABLE I

Data for 2-amino-1-methoxypropane

| Chloride Concentration (Normality) | Corrosion Rate Probe #1 (MPY) | Probe 1 Wash (ppm) 140° C. | Corrosion Rate Probe 2 (MPY) | Probe 2 Wash (ppm) 135° C. |
|---|---|---|---|---|
| 0.0032 | 0 | <1 | 0 | <1 |
| 0.004 | 5 | <1 | 15 | 10 |
| 0.005 | 2.5 | <1 | 33 | 32 |

TABLE II

Data for 1,3-methoxypropylamine

| Chloride Concentration (Normality) | Corrosion Rate Probe #1 (MPY) | Probe 1 Wash (ppm) 140° C. | Corrosion Rate Probe 2 (MPY) | Probe 2 Wash (ppm) 135° C. |
|---|---|---|---|---|
| 0.0016 | 0 | <1 | 0 | 3 |
| 0.0024 | 5 | <1 | 10 | 3 |
| 0.0033 | 2.5 | 3 | 12 | 7 |
| 0.005 | 2.5 | 2.6 | 20 | 34 |

Based upon the above data, 2-amino-1-methoxypropane can handle twice the chloride loading in the experimental unit with good dew point control than a comparable amount of 1,3-methoxypropylamine. The limit for 2-amino-1-methoxypropane is a chloride concentration of 0.0032N (0.012 mm Hg) while the limit for 1,3-methoxypropylamine is a chloride concentration of 0.0016N (0.006 mm Hg) at the same feed rates.

Based upon the above, and the surprising results obtained, we claim:

1. A process for neutralizing the acidic components occurring in the initial aqueous condensate of a distilling petroleum product which comprises adding to the distilling petroleum product an effective neutralizing amount of 2-amino-1-methoxypropane.

2. The process of claim 1 wherein the 2-amino-1-methoxypropane is added to the aqueous condensate contained in the overhead line of a distillation column in which said petroleum product is being distilled.

3. The process of claim 1 wherein the 2-amino-1-methoxypropane is added to the petroleum product before the petroleum product is distilled.

4. The process of claim 1 wherein the amount of 2-amino-1-methoxypropane added is sufficient to raise the pH of the aqueous condensate to above about 5.0.

5. The process of claim 4 wherein the amount of 2-amino-1-methoxypropane added is sufficient to raise the pH of the aqueous condensate to above about 6.0.

* * * * *